US012691366B2

(12) United States Patent
Fuchs

(10) Patent No.: US 12,691,366 B2
(45) Date of Patent: Jul. 28, 2026

(54) PINBALL MACHINES

(71) Applicant: University of Cincinnati, Cincinnati, OH (US)

(72) Inventor: Zachariah Fuchs, Cincinnati, OH (US)

(73) Assignee: University of Cincinnati, Cincinnati, OH (US)

( * ) Notice: Subject to any disclaimer, the term of this patent is extended or adjusted under 35 U.S.C. 154(b) by 793 days.

(21) Appl. No.: 17/986,770

(22) Filed: Nov. 14, 2022

(65) Prior Publication Data

US 2023/0149799 A1 May 18, 2023

Related U.S. Application Data

(60) Provisional application No. 63/278,729, filed on Nov. 12, 2021.

(51) Int. Cl.
*A63F 7/02* (2006.01)
*A63F 7/30* (2006.01)

(52) U.S. Cl.
CPC ..... *A63F 7/027* (2013.01); *A63F 7/30* (2013.01); *A63F 2007/303* (2013.01)

(58) Field of Classification Search
CPC .. A63F 7/027; A63F 7/02; A63F 7/025; A63F 7/30; A63F 2007/303; A63F 2007/3035; A63B 71/00
See application file for complete search history.

(56) References Cited

U.S. PATENT DOCUMENTS 2,967,713 A * 1/1961 Kumpman ..... A63F 7/0017 273/DIG. 26
3,770,276 A * 11/1973 Breslow ..... A63B 67/10 273/125 R
5,181,722 A * 1/1993 Krutsch ..... A63F 7/3065 273/127 R
5,284,342 A * 2/1994 Tanzer ..... A63F 7/027 273/127 R
5,356,141 A * 10/1994 Oursler ..... A63F 7/027 273/127 R
5,465,965 A * 11/1995 Wurz ..... A63F 7/3065 273/121 A
5,664,777 A * 9/1997 Nordman ..... A63F 7/027 273/127 R
5,833,236 A * 11/1998 Oursler ..... A63F 7/3075 273/127 R
5,938,195 A * 8/1999 Anghelo ..... A63F 7/027 273/127 R
10,926,166 B1 * 2/2021 Drake, Jr. ..... A63F 7/3075

FOREIGN PATENT DOCUMENTS

FR 2238509 A1 * 2/1975 ..... A63D 15/00

* cited by examiner

*Primary Examiner* — Grant Moubry
(74) *Attorney, Agent, or Firm* — DINSMORE & SHOHL LLP

(57) ABSTRACT

A pinball machine includes a pinball, a tabletop surface, and a play area on the tabletop surface. The play area includes a ramp including a raised surface rotatable about a rotational axis, an upward pass, and a downward pass. The upward pass extends between the tabletop surface and the raised surface and allows the pinball to move from the tabletop surface to the raised surface. The downward pass extends between the raised surface and the tabletop surface and allows the pinball to move from the raised surface to the tabletop surface.

20 Claims, 4 Drawing Sheets

PINBALL MACHINES

CROSS REFERENCE TO RELATED APPLICATIONS

The present application claims the benefit of U.S. Provisional Application Ser. No. 63/278,729, filed Nov. 12, 2021, which is hereby incorporated by reference in its entirety.

TECHNICAL FIELD

The present specification generally relates to pinball machines, and particularly to pinball machines having ramped and/or pendulum targets.

BACKGROUND

Pinball machines are games in which a pinball is moved to accomplish certain game objectives. Many pinball machines allow a player to move the pinball by striking the pinball with one or more levers or "flippers." In general, a player scores by activating the one or more flippers to cause the pinball to move across a play area and hit targets or specified locations in accordance with the particular games objectives.

SUMMARY

Additional features and advantages of the present disclosure will be set forth in the detailed description, which follows, and in part will be apparent to those skilled in the art from that description or recognized by practicing the embodiments described herein, including the detailed description, which follows the claims, as well as the appended drawings.

In one embodiment, a pinball machine includes a pinball, a tabletop surface, and a play area on the tabletop surface. The play area includes a ramp including a raised surface rotatable about a rotational axis, an upward pass, and a downward pass. The upward pass extends between the tabletop surface and the raised surface and allows the pinball to move from the tabletop surface to the raised surface. The downward pass extends between the raised surface and the tabletop surface and allows the pinball to move from the raised surface to the tabletop surface.

In another embodiment, a pinball machine includes a pinball, a tabletop surface, and a play area on the tabletop surface. The play area includes a pendulum assembly movable between a rest position and a rotated position. The pendulum assembly includes a pendulum suspended from a frame, a weighted ball coupled to a bottom of the pendulum, and a stationary ball coupled to the tabletop surface and positioned adjacent the weighted ball when the pendulum assembly is in the rest position.

In yet another embodiment, a pinball machine includes a pinball, a tabletop surface, a play area on the tabletop surface, a motor, and a controller. The play area includes a ramp including a raised surface rotatable about a rotational axis, the raised surface defining a ball drop aperture therethrough, an upward pass extending between the tabletop surface and the raised surface and allows the pinball to move from the tabletop surface to the raised surface, and a downward pass extending between the raised surface and the tabletop surface and allows the pinball to move from the raised surface to the tabletop surface. The motor is operatively coupled to the raised surface and configured to rotate the raised surface about the rotational axis. The controller is communicatively coupled to the motor and configured to control rotation of the raised surface.

It is to be understood that both the foregoing general description and the following detailed description describe various embodiments and are intended to provide an overview or framework for understanding the nature and character of the claimed subject matter. The accompanying drawings are included to provide a further understanding of the various embodiments and are incorporated into and constitute a part of this specification. The drawings illustrate the various embodiments described herein, and together with the description, explain the principles and operations of the claimed subject matter.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
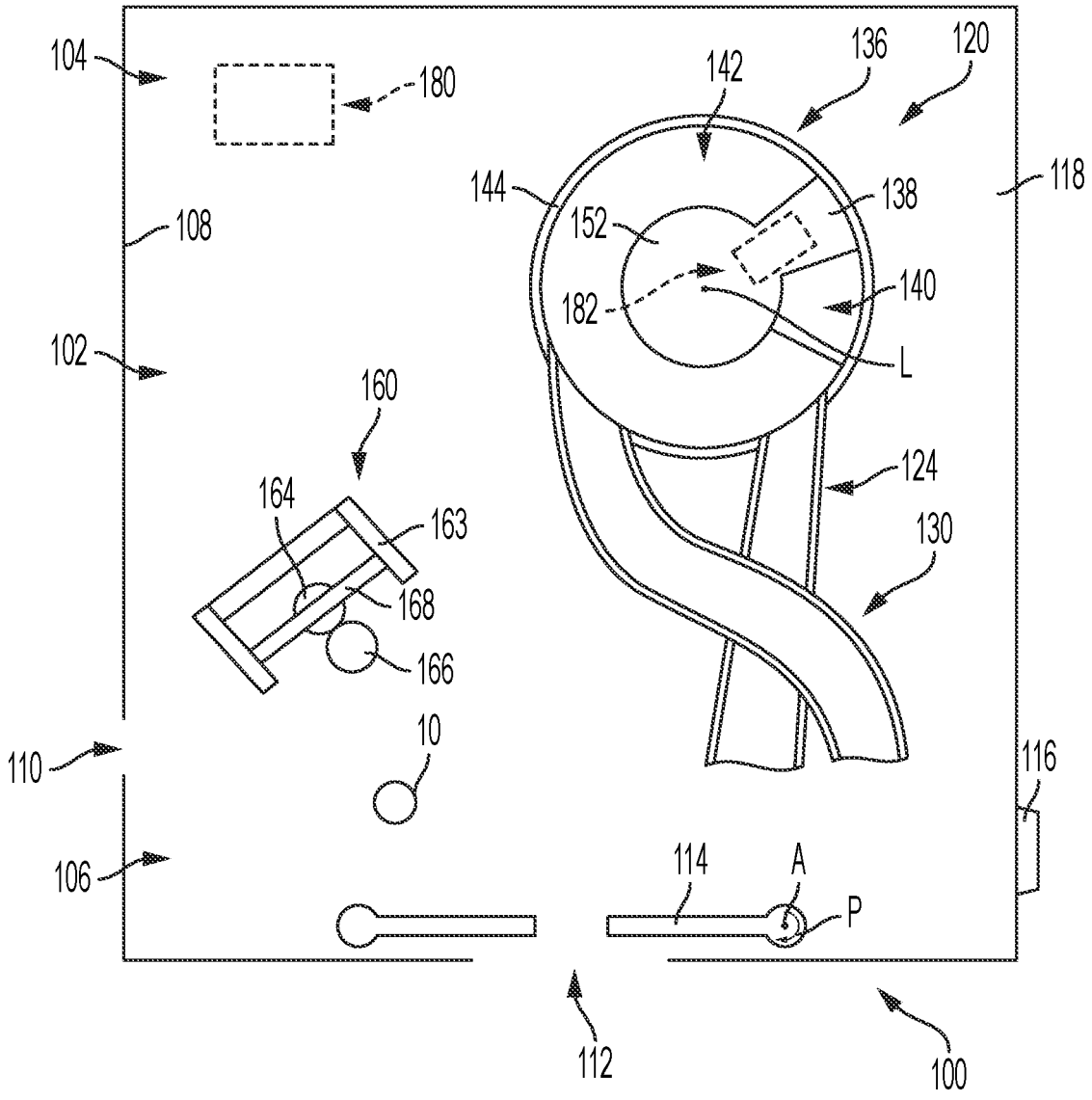
FIG. 1 schematically depicts a top view of a pinball machine, according to one or more embodiments shown and described herein.

Reference will now be made in detail to various embodiments of pinball machines, examples of which are illustrated in the accompanying drawings. Whenever possible, the same reference numerals will be used throughout the drawings to refer to the same or like parts. FIG. 1 schematically depicts a pinball machine including a pinball, a tabletop surface, and a play area on the tabletop surface. The play area includes, in some embodiments, a ramp including a raised surface rotatable about a rotational axis, an upward pass, and a downward pass. The upward pass extends between the tabletop surface and the raised surface and is configured to enable the pinball to move from the tabletop surface to the raised surface. The downward pass extends between the raised surface and the tabletop surface and is configured to enable to pinball to move from the raised surface to the tabletop surface. In some embodiments in addition to or in lieu of the ramp, a pendulum assembly may be included. The pendulum assembly may include a pendulum suspended from a frame, a weighted ball coupled to a bottom of the pendulum, and a stationary ball coupled to the tabletop surface and positioned adjacent the weighted ball when the pendulum assembly is in the rest position. The various targets and/or obstacles provided by the ramp and/or the pendulum provide new, unique features, and/or gaming experiences as will be described in greater detail below.

Directional terms as used herein—for example up, down, right, left, front, back, top 104, bottom 106—are made only with reference to the figures as drawn and are not intended to imply absolute orientation unless otherwise specified.

Unless otherwise expressly stated, it is in no way intended that any method set forth herein be construed as requiring that its steps be performed in a specific order, nor that with any apparatus specific orientations be required. Accordingly, where a method claim does not actually recite an order to be followed by its steps, or that any device or assembly claim does not actually recite an order or orientation to individual components, or it is not otherwise specifically stated in the claims or description that the steps are to be limited to a specific order, or that a specific order or orientation to components of an device or assembly is not recited, it is in no way intended that an order or orientation be inferred, in any respect. This holds for any possible non-express basis for interpretation, including: matters of logic with respect to arrangement of steps, operational flow, order of components, or orientation of components; plain meaning derived from grammatical organization or punctuation; and the number or type of embodiments described in the specification.

As used herein, the singular forms "a," "an," and "the" include plural referents unless the context clearly dictates otherwise. Thus, for example, reference to "a" component includes aspects having two or more such components, unless the context clearly indicates otherwise.

Referring to FIG. 1, an embodiment of a pinball machine 100 is schematically shown. The pinball machine 100 may include a tabletop surface 118 and a play area 102 arranged on the table top surface 118. The play area 102 generally includes structure, obstacles, and/or targets mounted to the tabletop surface 118. The tabletop surface 118 and the play area 102 may generally extend between a top end 104 and a bottom end 106. The tabletop surface 118 and/or the play area 102 may be tilted or angled such that the bottom 106 of the play area 102 may be gravitationally lower than the top 104 of the play area 102. The pinball machine 100 further includes a pinball 10. Accordingly, the pinball 10, may tend toward the bottom 106 of the play area 102 and/or tabletop surface 118.

The pinball machine 100 may include a border 108, which may surround the play area 102 wholly or in part. In embodiments, the border 108 may be raised relative to the play area. In some embodiments, the border 108 may be coupled to a glass or transparent substrate to enclose and protect the play area 102. The pinball machine 100 may further include a pinball entrance 110 and a pinball exit 112. In some embodiments, the pinball entrance 110 and the pinball exit 112 may be apertures through the border 108. The pinball exit 112 may be located at or near the bottom 106 of the play area 102. Accordingly, the pinball 10, which may tend toward the bottom 106 of the play area 102, may also tend toward the pinball exit 112. The pinball entrance 110 may be arranged above the pinball exit 112 (e.g., closer to the top 104 of the play area 102 than the pinball exit 112).

The pinball machine 100 may include one or more flippers 114 within the play area 102. In particular, in some embodiments, the one or more flippers 114 may be positioned adjacent the pinball exit 112. Each of the one or more flippers 114 may be rotatable about an axis A such that the one or more flippers 114 may rotate toward the top 104 of the play area 102 (e.g., in the depicted rotational direction P). Each of the one or more flippers 114 may be coupled to a user input device 116 such as a button, lever, or other movable or togglable device. In particular, each of the one or more flippers 114 may be coupled to said user input device 116 such that activation of the user input device 116 may cause a corresponding movement of the one or more flippers 114. Accordingly, a player may activate the user input device 116 to move the one or more flippers 114 which may, in some circumstances, cause the one or more flippers 114 to rotate into contact with the pinball 10 (e.g., in the depicted rotational direction P). This may, in turn, cause the pinball 10 to move upward along the play area 102 (e.g., toward the top 104 of the play area 102) and away from the pinball exit 112. It is noted that while only one user input device 116 is depicted, in embodiments, each flipper 114 may have a dedicated user input device 116.

The pinball machine 100 may include various obstacles and/or targets toward which a user may direct the pinball 10 using the one or more flippers 114. For example, and referring to FIGS. 1-3 in combination, the pinball machine 100 may include a ramp 120. The ramp 120 may include a raised surface 122 and an upward pass 124 extending between the tabletop surface 118 and the raised surface 122. The upward pass 124 may be configured and positioned such that the pinball 10 may move from the tabletop surface 118 to the raised surface 122 of the ramp 120 along the upward pass 124. The upward pass 124 may extend between the tabletop surface 118 and the raised surface 122 along a substantially linear direction, such as depicted. However, it is contemplated that the upward pass 124 may curve, undulate, or the like. The upward pass 124 may have sides 126, which, in some embodiments, may be bound by sidewalls 128. In some embodiments, the sidewalls 128 may be substantially flat or planar, such as depicted or, in some embodiments, sidewalls 128 may be curved such that the sidewalls 128 and the upward pass 124 form a U-shaped cross section. In some embodiments, the sidewalls 128 may extend at about 90 degree angles from the upward pass 124, such as depicted. In other embodiments, the sidewalls 128 may extend at acute or obtuse angles from the upward pass 124. The sidewalls 128 may prevent the pinball 10 from traveling over the sides 126 of the upward pass 124. In some embodiments, the upward pass 124 may be wider at the tabletop surface 118 than at the raised surface 122 such as depicted. In other words, the distance between the sides 126 of the upward pass 124 may be greater at the tabletop surface 118 than at the raised surface 122. The wider geometry of the upward pass 124 at the tabletop surface 118 may increase the likelihood or ease that the pinball 10 enters the upward pass 124.

The ramp 120 may further include a downward pass 130 extending between the raised surface 122 and the tabletop surface 118. Accordingly, the pinball 10 may move from the raised surface 122 to the tabletop surface 118 along the downward pass 130. The downward pass 130 may extend between the raised surface 122 and the tabletop surface 118 along a curved or serpentine path, such as depicted. In other embodiments, the downward pass 130 may extend between the raised surface 122 and the tabletop surface 118 along a straight path. The downward pass 130 may have sides 132, which, in some embodiments, may be bound by sidewalls 134. In some embodiments, the sidewalls 134 may be curved such that the sidewalls 134 and the downward pass 130 form a U-shaped cross section such as depicted. In other embodiments, the sidewalls 134 may be substantially flat or planar. The sidewalls 134 may prevent the pinball 10 from traveling over the sides 132 of the downward pass 130.

The ramp 120 may include a rotating ball diverter 136. The rotating ball diverter 136 may include the raised surface 122 and a rotating wall 138. The raised surface 122 and the rotating wall 138 may be coupled such that the raised surface 122 and the rotating wall 138 may rotate together. For example, the rotating wall 138 and the raised surface 122 may be coupled via screws, adhesive or other attachment mechanism or may be integrally formed. In embodiments, the rotating wall 138 may extend orthogonally from the raised surface 122 (e.g., into and out of FIG. 1). The rotating wall 138 and the raised surface 122 may each be rotatable about a rotational axis L in a rotational direction θ.

The rotating ball diverter 136 may define a ball drop aperture 140 through the raised surface 122. Stated another way, the raised surface 122 may define the ball drop aperture 140 therethrough. The ball drop aperture 140 may be positioned adjacent the rotating wall 138. In particular, in embodiments, the ball drop aperture 140 may be directly adjacent the rotating wall 138 in the −θ direction of the depicted cylindrical coordinate system. The ball drop aperture 140 may provide an alternative route to the tabletop surface 118 as opposed to the downward pass 130.

Figure 2:
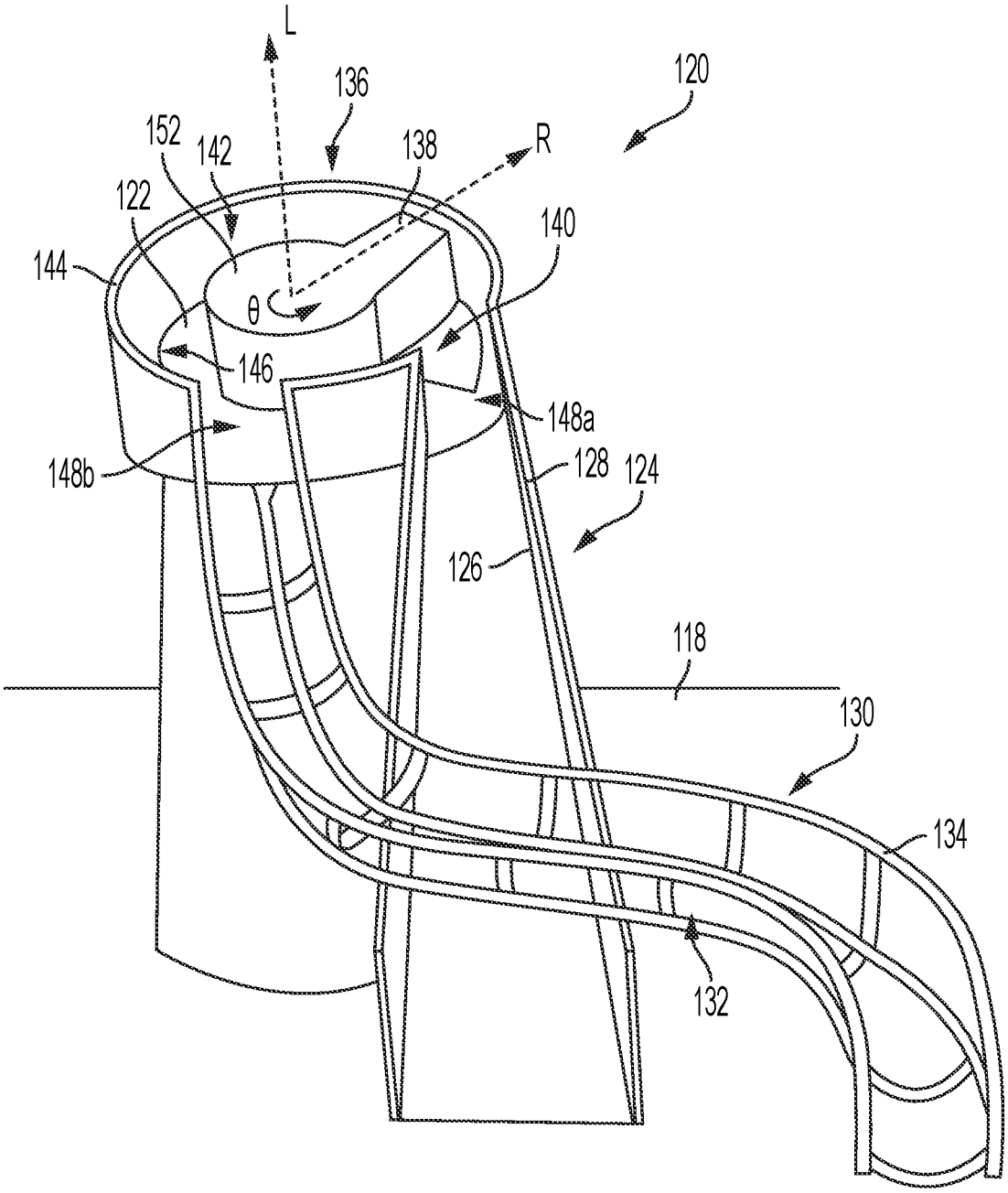
FIG. 2 schematically depicts a perspective view of a ramp of the pinball machine of FIG. 1, according to one or more embodiments shown and described herein.

As depicted in FIGS. 1 and 2, the raised surface 122 may provide a pinball path 142. The rotating wall 138 may extend radially across the pinball path 142 (e.g. in the R direction of the depicted cylindrical coordinate system) such that it blocks or substantially blocks the pinball 10 to and/or from the upward pass 124 and/or the downward pass 130. Accordingly such as depicted in FIG. 2, in embodiments, as the pinball 10 travels up the upward pass 124, the pinball 10 may strike the rotating wall 138 and/or may drop through the ball drop aperture 140 or otherwise prevented from traveling along the pinball path 142.

The rotating ball diverter 136 may include a circumferential wall 144. The circumferential wall 144 may surround a perimeter 146 of the raised surface 122. Accordingly, the circumferential wall 144 may enclose the pinball path 142 and may prevent the pinball 10 from dropping over the perimeter 146 of the raised surface 122. In some embodiments, the circumferential wall 144 may not rotate with the raised surface 122 and may instead be stationary. As depicted, the circumferential path may define openings 148*a*, 148*b* at the upward pass 124 and the downward pass 130, respectively. Accordingly, the circumferential wall 144 may not prevent the pinball 10 from moving onto or off of the raised surface 122 via the upward pass 124 or the downward pass 130.

Figure 3:
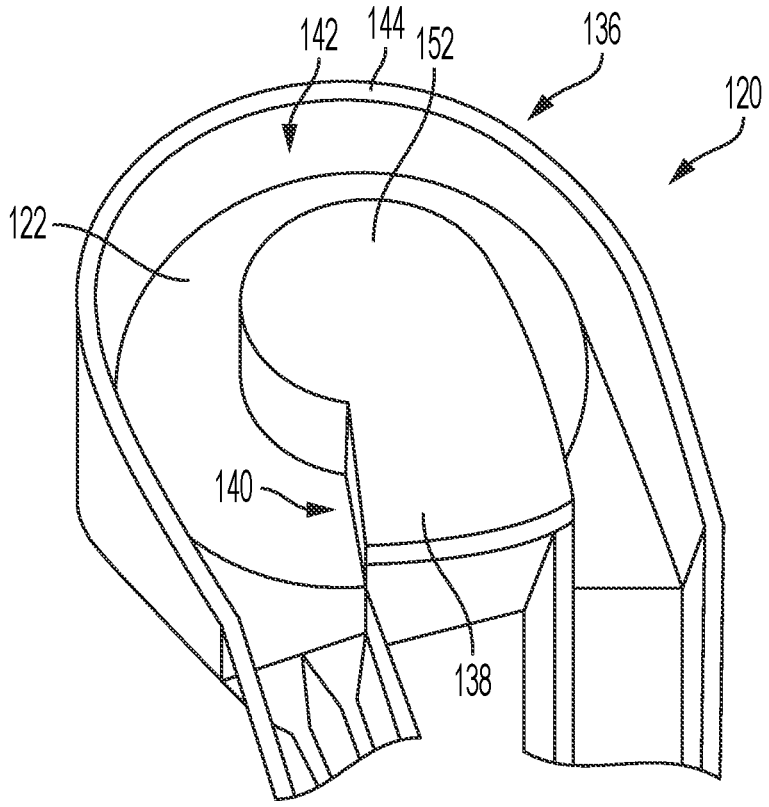
FIG. 3 schematically depicts a raised surface of the ramp rotated about a rotational axis, according to one or more embodiments shown and described herein.

In light of FIGS. 1 and 2, it will now be appreciated that, after the pinball 10 moves up the upward pass 124, depending upon the current position of the rotating wall 138, the pinball 10 will either strike the rotating wall 138 and/or fall through the ball drop aperture 140. However, with the rotatable wall rotated out of the way, such as depicted in FIG. 3, the pinball 10 may move to the downward pass 130 and travel down the downward pass 130.

Still referring to FIGS. 1 and 2, the rotating ball diverter 136 may include a motor 152, schematically depicted. The motor 152 may be coupled to the raised surface 122 and/or the rotating wall 138. In embodiments, the motor 152 may be togglable between an active state and a passive state, via a controller 180 (schematically depicted in FIG. 1). In the active state, the motor 152 may actively rotate the raised surface 122 and the rotating wall 138 about the rotational axis L. In the passive state, the motor 152 may passively allow the raised surface 122 to rotate in response to a force, such as from the pinball 10 colliding with the rotating wall 138. In other words, the force with which the pinball 10 contacts the rotating wall 138 may cause the rotating wall 138 and the raised surface 122 to rotate.

In some embodiments, the motor 152 may have a stopped state. In the stopped state, the motor 152 may prevent rotation of the raised surface 122. In some embodiments, the motor 152 may position the raised surface 122 at a designated rest position when in the stopped state. For example, the motor 152 may position the raised surface 122 such that the rotating wall 138 is positioned between the upward pass 124 and the downward pass 130. Accordingly, when the motor 152 is in the stopped state, the pinball 10 may move from the upward pass 124, about the raised surface 122, and down the downward pass 130 without contacting the rotating wall 138. In embodiments, the pinball machine 100 may allow a player to select between one or more game options such as via the controller. For example, in some embodiments, the player may select between playing with the motor 152 in the active state, in the passive state, or in the stopped state. This may enable different types of pinball games to be played with the pinball machine 100.

The controller 180 may control various operations of the pinball machine 100 and may be any type of computing device and may include one or more processors and one or more memory modules. The one or more processors may include any device capable of executing machine-readable instructions stored on a non-transitory computer-readable medium. Accordingly, each of the one or more processors may include an integrated circuit, a microchip, a computer, and/or any other computing device.

The one or more memory modules may be communicatively coupled to the one or more processors. The one or more memory modules may be configured as volatile and/or nonvolatile memory and, as such, may include random access memory (including SRAM, DRAM, and/or other types of RAM), flash memory, secure digital (SD) memory, registers, compact discs (CD), digital versatile discs (DVD), and/or other types of non-transitory computer-readable mediums. Depending on the particular embodiment, these non-transitory computer-readable mediums may reside within the pinball machine 100 and/or external to the pinball machine 100. The one or more memory modules may be configured to store one or more pieces of logic as described in more detail below. The embodiments described herein may utilize a distributed computing arrangement to perform any portion of the logic described herein.

Embodiments of the present disclosure include logic that includes machine-readable instructions and/or an algorithm written in any programming language of any generation (e.g., 1GL, 2GL, 3GL, 4GL, and/or 5GL) such as, machine language that may be directly executed by the one or more processors, assembly language, object-oriented programming (OOP), scripting languages, microcode, etc., that may be compiled or assembled into machine-readable instructions and stored on a machine-readable medium. Similarly, the logic and/or algorithm may be written in a hardware description language (HDL), such as logic implemented via either a field-programmable gate array (FPGA) configuration or an application-specific integrated circuit (ASIC), and their equivalents. Accordingly, the logic may be implemented in any conventional computer programming language, as pre-programmed hardware elements, and/or as a combination of hardware and software components. Logic may include game logic, scoring logic, or the like.

In embodiments, the rotating ball diverter 136 may include one or more contact sensors 182 (see FIG. 1) communicatively coupled to the controller 180. In particular, the rotating ball diverter 136 may include one or more contact sensors 182 coupled to the rotating wall 138. The one or more contact sensors 182 may be configured to output a signal indicative of the pinball 10 in contact with the rotating wall 138. For example, the one or more contact sensors 182 may be, but are not limited to positional sensors, rotational sensors, angular velocity sensors, velocity sensors, force sensors, or the like. The controller 180 may receive the signal from the one or more contact sensors 182 to determine a contact by the pinball 10 with the rotating wall 138 has been made. Based on the indication that the pinball 10 has contacted the rotating wall 138, the controller may operate the motor to rotate the rotating ball diverter 136 to direct the pinball 10 per the particular game logic, randomly, or the like. In some embodiments, the motor may be in a passive state until it is determined that the pinball 10 has contacted the rotating wall 138. That is, in some embodiments, the controller 180 may activate the motor 152 from the passive state to the active state in response to the contact by the pinball 10.

In light of FIGS. 1-3, it will now be appreciated that, in some embodiments, during a pinball game the controller 180 may determine or output a score based on sensor input from the one or more contact sensors 182. For example, in some embodiments, points may be scored when the pinball 10 contacts the rotating wall 138. In some embodiments, a score may be determined by the controller 180 as a function of the force with which the pinball 10 contacts the rotating wall 138 or as a function of how far the rotating wall 138 moves as a result of the pinball 10 contacting the rotating wall 138, such as when the motor is in the passive mode. In some embodiments, the pinball game may have customizable or adjustable scoring. For example, in some embodiments, a player may select between scoring rules (e.g., between scoring as a function of if the pinball 10 contacts the rotating wall 138 and scoring as a function of the force with which the pinball 10 contacts the scoring wall) via the controller 180 (such as via one or more user input devices). This may allow for a greater range of pinball game options.

In various embodiments, the controller 180 may, using the output of the one or more contact sensors 182 measure, in real or near-real time the variable direction, speed, and/or position of the rotating ball diverter 136.

Figure 4:
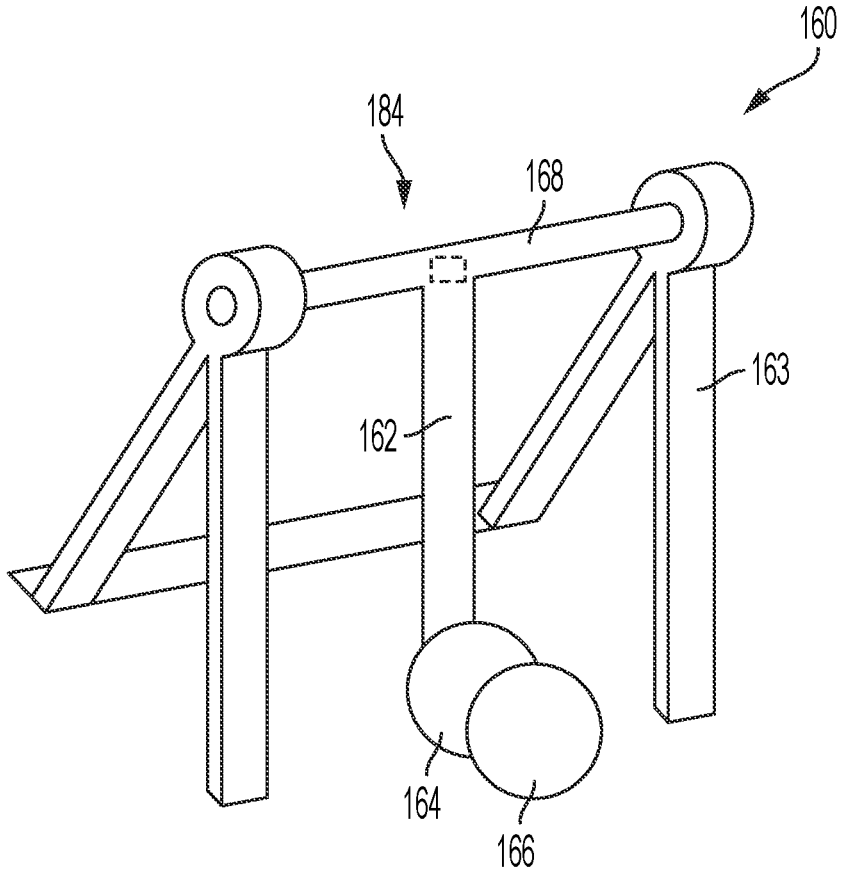
FIG. 4 schematically depicts a perspective view of a pendulum assembly of the pinball machine of FIG. 1, according to one or more embodiments shown and described herein.

Referring now to FIGS. 1 and 4 in combination, the pinball machine 100 may include a pendulum assembly 160. The pendulum assembly 160 may include a pendulum 162 suspended from a frame 163. In embodiments, the pendulum assembly 160 includes a pin 168, which may be rotatably coupled to a top of the pendulum 162 to form a hinged joint. Accordingly, a bottom of the pendulum 162 may rotate or swing about the pin 168 of the frame 163. In particular, the pendulum 162 may move between a rest position (such as depicted) and a rotated position wherein the pendulum 162 is rotated about the pin 168 and away from the rest position. At the bottom of the pendulum 162, the pendulum 162 may include a weighted ball 164.

The pendulum assembly 160 may include a stationary ball 166. The stationary ball 166 may be substantially the same size, shape, and/or material as the weighted ball 164 of the pendulum 162. The stationary ball 166 may be positioned adjacent to and in contact with the weighted ball 164 when the pendulum 162 is in the rest position. As may be appreciated, if the pinball 10 contacts the stationary ball 166, the stationary ball 166 may transfer momentum to the pendulum 162, which may cause the pendulum 162 to move from the rest position to the rotated position. The pendulum 162 may then return to the rest position. It is noted that because of the spherical shape of the stationary ball, the stationary ball 166 may be contacted by the pinball 10 in a number of directions while still allowing force transfer to the pendulum 162.

In embodiments, the pendulum assembly 160 may include one or more pendulum sensors 184 communicatively coupled to the controller 180. For example, the one or more pendulum sensors 184 may include positional sensors, rotational sensors, angular velocity sensors, velocity sensors, force sensors, or the like. The one or more pendulum sensors 184 may output a signal indicative of a movement of the pendulum assembly 160 (e.g., the pendulum 162). The controller 180 may be configured to execute logic which allows the controller to determine, based on the pendulum sensor signal, how far the pendulum 162 swings, with what force the pendulum 162 was contacted, and/or how many consecutive contacts with the stationary ball 166 occurred. Such information may be provided continuously and in real or near-real time.

In embodiments, the controller 160 may output a score based on the signal of the one or more pendulum sensors 184. For example, the controller 180 may calculate the score as a function of whether the pinball 10 contacts the stationary ball 166 and/or as a function of the force with which the pinball 10 contacts the stationary ball 166. In some embodiments, a pinball game may include scoring as a function of the distance that the pendulum 162 travels when the stationary ball 166 is contacted by the pinball 10.

In view of the above, it should now be understood that at least some embodiments of the present disclosure are directed to a pinball machine including various targets that provide new and unique pinball game experiences and new ways to score performance for interaction with those targets such as the above-described ramp and pendulum assembly.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A pinball machine comprising:

a pinball;

a tabletop surface; and a play area on the tabletop surface, the play area comprising:

a ramp comprising:

a raised surface rotatable about a rotational axis, the raised surface defining a ball drop aperture;

an upward pass extending between the tabletop surface and the raised surface and allows the pinball to move from the tabletop surface to the raised surface; and a downward pass extending between the raised surface and the tabletop surface and allows the pinball to move from the raised surface to the tabletop surface, and a rotating wall coupled to the raised surface and positioned adjacent to the ball drop aperture, wherein the ball drop aperture provides a pathway to drop the pinball traveling therethrough from the raised surface to the tabletop surface.

2. The pinball machine of claim 1, further comprising a motor operatively coupled to the raised surface and configured to rotate the raised surface about the rotational axis.

3. The pinball machine of claim 2, wherein the motor is togglable between an active state and a passive state, wherein the motor rotates the raised surface when in the active state and passively allows the raised surface to rotate when in the passive state.

4. The pinball machine of claim 2, wherein the motor has a stopped state, wherein the motor prevents rotation of the raised surface when in the stopped state.

5. The pinball machine of claim 1, further comprising:
- a motor operatively coupled to the raised surface and configured to rotate the raised surface about the rotational axis;
- a contact sensor configured to output a signal indicative of the pinball in contact with the rotating wall; and
- a controller communicatively coupled to the motor and the contact sensor.

6. The pinball machine of claim 5, wherein the controller is configured to detect the pinball in contact with the rotating wall and operate the motor to rotate the rotating wall in response to the pinball contacting the rotating wall.

7. The pinball machine of claim 1, wherein the ramp comprises multiple downward passes.

8. A pinball machine comprising:
- a pinball;
- a tabletop surface; and
- a play area on the tabletop surface, the play area comprising:
  - a pendulum assembly movable between a rest position and a rotated position and comprising:
    - a pendulum suspended from a frame;
    - a weighted ball coupled to a bottom of the pendulum; and
    - a stationary ball coupled to the tabletop surface and positioned adjacent the weighted ball when the pendulum assembly is in the rest position.

9. The pinball machine of claim 8, wherein the pendulum assembly moves from the rest position to the rotated position when the stationary ball is contacted by the pinball.

10. The pinball machine of claim 8, further comprising one or more pendulum sensors configured to output a signal indicative of a movement of the pendulum assembly between the rest position and the rotated position.

11. The pinball machine of claim 10, further comprising a controller communicatively coupled to the one or more pendulum sensors, the controller operable to calculate a score based on the signal from the one or more pendulum sensors.

12. The pinball machine of claim 8, wherein the play area further comprises:
- a ramp comprising:
  - a raised surface rotatable about a rotational axis;
  - an upward pass extending between the tabletop surface and the raised surface and allows the pinball to move from the tabletop surface to the raised surface; and
  - a downward pass extending between the raised surface and the tabletop surface and allows the pinball to move from the raised surface to the tabletop surface.

13. The pinball machine of claim 8, further comprising one or more pendulum sensors selected from a positional sensor, a rotational sensor, an angular velocity sensor, a velocity sensor, a force sensor, and combinations thereof.

14. A pinball machine comprising:
- a pinball;
- a tabletop surface; and
- a play area on the tabletop surface, the play area comprising:
  - a ramp comprising:
    - a raised surface rotatable about a rotational axis, the raised surface defining a ball drop aperture, the ball drop aperture providing a pathway to drop the pinball traveling therethrough from the raised surface to the tabletop surface;
    - an upward pass extending between the tabletop surface and the raised surface and allows the pinball to move from the tabletop surface to the raised surface;
    - a downward pass extending between the raised surface and the tabletop surface and allows the pinball to move from the raised surface to the tabletop surface; and
    - a rotating wall coupled to the raised surface and positioned adjacent to the ball drop aperture;
- a motor operatively coupled to the raised surface and configured to rotate the raised surface about the rotational axis; and
- a controller communicatively coupled to the motor and configured to control rotation of the raised surface.

15. The pinball machine of claim 14, wherein:
- the ramp further comprises:
  - a contact sensor configured to output a signal indicative of the pinball in contact with the rotating wall; and wherein the controller is configured to calculate a score based on the signal from the contact sensor.

16. The pinball machine of claim 15, wherein the controller calculates the score as a function of a force with which the pinball contacts the rotating wall.

17. The pinball machine of claim 14, wherein the play area further comprises:
- a pendulum assembly movable between a rest position and a rotated position and comprising:
  - a pendulum suspended from a frame;
  - a weighted ball coupled to a bottom of the pendulum; and
  - a stationary ball coupled to the tabletop surface and positioned adjacent the weighted ball when the pendulum assembly is in the rest position.

18. The pinball machine of claim 17, wherein:
- the pendulum assembly further comprises one or more pendulum sensors communicatively coupled to the control and configured to output a signal indicative of a movement of the pendulum assembly between the rest position and the rotated position; and
- the controller calculates a score based on the signal of the one or more pendulum sensors.

19. The pinball machine of claim 18, wherein the controller calculates the score as a function of a force with which the pinball contacts the stationary ball.

20. The pinball machine of claim 18, wherein the controller calculates the score as a function of a distance that the pendulum travels.

* * * * *